US005393067A

United States Patent [19]

Paulsen et al.

[11] Patent Number: 5,393,067

[45] Date of Patent: Feb. 28, 1995

[54] SYSTEM, METHOD AND APPARATUS FOR GENERATING LARGE JACKPOTS ON LIVE GAME CARD TABLES

[75] Inventors: Craig A. Paulsen; Logan L. Pease; William K. Bertram; Wes F. Carmean, all of Reno; Joseph R. Hedrick, Sparks; Ward W. Chilton, Reno, all of Nev.

[73] Assignee: IGT, Reno, Nev.

[21] Appl. No.: 6,908

[22] Filed: Jan. 21, 1993

[51] Int. Cl.[6] ..... A63F 1/00; A63F 1/06

[52] U.S. Cl. ..... 273/292; 194/239; 273/309

[58] Field of Search ..... 273/292, 309, 138 A, 273/85 CP, 9, 143 R, 439, 274; 194/217, 219, 239, 328, 344, 346, 350, 351; 73/163

[56] References Cited

U.S. PATENT DOCUMENTS

| | | | |
|---|---|---|---|
| 3,939,953 | 2/1976 | Miyazawa | 194/346 X |
| 4,652,998 | 3/1987 | Koza et al. | 273/274 X |
| 4,659,087 | 4/1987 | Shen et al. | 273/274 |
| 4,837,728 | 6/1989 | Barrie et al. | 273/143 R X |
| 4,861,041 | 8/1989 | Jones et al. | 273/309 X |
| 5,098,107 | 3/1992 | Boylan et al. | 273/292 |
| 5,112,060 | 5/1992 | Jones | 273/309 |
| 5,248,142 | 9/1993 | Breeding | 273/292 |

FOREIGN PATENT DOCUMENTS

| | | | |
|---|---|---|---|
| 443420 | 8/1991 | European Pat. Off. | 273/138 A |

OTHER PUBLICATIONS

John Scarne, Scarne's Encyclopedia of Games, 1973 pp. 278–279.

*Primary Examiner*—Paul E. Shapiro

*Attorney, Agent, or Firm*—Townsend and Townsend Khourie and Crew

[57] ABSTRACT

A system to generate large (e.g. $1 million) jackpots for live card games such as blackjack is disclosed. Multiple live card tables are placed in one or more gaming establishments. A coin acceptor is assigned to each player position on the tables and includes a sensor for determining the presence of a coin to generate a signal indicating that a jackpot side bet has been placed and to correspondingly increase the available jackpot that is being accumulated from the side bets on all tables. The coin acceptors are mounted directly to the playing tables. The acceptors have a low profile above the table top and include sloping surfaces to facilitate the insertion and withdrawal of coins from them. Each coin acceptor communicates with a central computer or processor. The computer keeps track of jackpot accumulations, deducts winnings therefrom, controls strategically positioned displays to inform players and dealers of the size of the available jackpot or jackpots, and the table includes controls adjacent the dealer position to prevent late betting and pay winning players their jackpots. To generate the large jackpots, blackjack is played with six full decks of cards, and winning blackjack hands are selected to have the requisite low probability of occurrence.

45 Claims, 5 Drawing Sheets

SYSTEM, METHOD AND APPARATUS FOR GENERATING LARGE JACKPOTS ON LIVE GAME CARD TABLES

BACKGROUND OF THE INVENTION

The present invention enhances the attractiveness and excitement of live card games in general, and the card game known as "21" or blackjack in particular, by adding to such games a large jackpot component which is comparable in size to large jackpots which are now routinely won in casinos when playing slot machines large numbers of which are combined in a single, enhanced jackpot payoff system.

The creation of large jackpots with slot machines is well known and relatively easy because of the large number of such machines which are in operation and the ease with which these machines can be electronically combined. The large jackpots are generated by accumulating a portion of each bet placed in each machine on the system and establishing sufficiently low odds for winning the jackpot that the likelihood of winning the jackpot on any single game becomes extremely small. The electromechanical character of the machines and the absence of an intervening dealer who participates in each game on the part of the casino makes it relatively easy to generate large jackpots, say, in excess of $1 million.

The same is not true for live card games. Such games are neither mechanically nor electrically played, but with a dealer who represents the house (casino). This increases the difficulty of retaining parts of the bets placed during the games and accumulating them in a jackpot, with high odds against winning it. In addition, in live card games the dealer must determine when a player has a jackpot winning hand, which further complicates the setup and generation of truly large jackpots.

U.S. Pat. No. 4,861,041, the disclosure of which is incorporated herein by reference, discloses a live card game, primarily poker or blackjack, which has a jackpot component. However, this patent only discloses to accumulate a jackpot based on bets placed on a single card game for the simple reason that nobody can keep track of bets placed on multiple tables in the casino, much less placed on multiple tables in different gaming establishments within a given locality, be this a single city or an entire state or country.

Although the live card game disclosed in the '041 patent is capable of generating a jackpot, it is necessarily of only modest size for two reasons. First, the number of players that may participate in the jackpot is limited to the number of players on a particular table. Secondly, especially for blackjack, the probability of reaching 21 even with the combination of cards which has the smallest probability of reaching this number is relatively high. Consequently, players will win the jackpot in the system disclosed in the '041 patent quite frequently so that there is never enough time to accumulate more than a modest jackpot at best.

As a result, live card games could never match the large size of jackpots that can be won when playing mechanical or video slot machines, for example. Even though playing live card games is very popular, at least in part because when playing a card game a player can utilize his skill and knowledge of the game to at least make him believe he can enhance his chances of winning, he never has the chance to win large sums of money which are even remotely comparable to the multi-million dollar jackpots that are frequently paid out by casinos which participate in systems made up of thousands or tens of thousands of slot machines all of which pay a percentage of the bets into a common jackpot pool.

Thus, to enhance the attractiveness of live card games and to provide greater player satisfaction, there is a need to modify live card games so that truly large jackpots; e.g. in excess of $100,000 or $1 million, for example, can be won and, of course, there is a need for a system which can accomplish this.

SUMMARY OF THE INVENTION

Pursuant to the present invention, live card games, and in particular blackjack, continue to be played on individual card playing tables pursuant to customary rules of play. According to the invention, a separate jackpot play or component is superimposed. For this, many tables, located within a single gaming establishment such as a casino or in multiple casinos which may be distributed throughout the city, state or country, play together. Consequently, there is no limit to the number of players who can participate in the jackpot play.

In addition, the present invention modifies the odds of winning a jackpot by greatly reducing the probability for such a win. This is accomplished by playing on all tables within the system with multiple; e.g. six, complete decks of cards and selective card combinations from the decks of cards which have a very low probability of occurrence.

By combining the low probability of winnings with a large number of players who can participate in the jackpot play, the present invention makes it possible to dramatically increase the size of the jackpots that can be won, because the probability of winning them becomes so low and, further, by having such large jackpots occur at sufficiently frequent intervals, because of the participation of many players therein, to attract and keep the attention of the players and, therefore, ensure the desired player participation in the game.

Broadly speaking, this is accomplished in accordance with the present invention by setting up a system which combines a plurality and typically a large number of live card gaming tables on which individual card games; e.g. blackjack, are played for participation in the jackpot component of the game. Jackpot-winning hands of cards are selected so that the probability of such a win is low. Precisely how low the probability should be is a function of the desired maximum size of the jackpot and is readily calculated by those skilled in the art. In a presently preferred embodiment of the invention which contemplates jackpot sizes of $1 million and more, each table plays with six full decks of cards, and winning hands of cards are, for example, four 5s of the same suit; e.g. hearts or spades, plus an ace. Other card combinations can, of course, be substituted, such as, for example, a winning hand consisting of three 7s of the same suit when the size of the jackpot need not be as large.

As a refinement, to retain player interest and satisfaction, the present invention further contemplates to establish a plurality of jackpot winnings, a very large jackpot as defined above, and much lesser, more frequently won jackpots of $50 and $100 each, for example.

The overall system employed by the present invention places a plurality of live card tables in one or more gaming establishments. Each table has a plurality of positions for participating players and a dealer position. Each player position includes a coin acceptor where a player who wishes to participate in the jackpot component of the game can place a corresponding side bet; e.g. a coin or a token (hereinafter generally referred to as "coin" without further distinguishing between the two). The acceptor senses when a coin has been placed on it and generates a signal which is fed to a central processor or computer that keeps track of and accumulates the available jackpot on the basis of the side bets which have been placed. Typically, the computer will accumulate less than the full amount of the bet; e.g. a percentage thereof, which may, for example, lie in the range of between 90%–97% of each side bet. Further, the central computer, preferably a commercially available DEC Micro VAX 3100-40 or a similar computer, may divide the accumulating jackpot bets into two or three categories; for example, one main (large) jackpot and one or two lesser, more frequently hit jackpots as discussed above.

The system includes appropriate displays on or in the vicinity of the card tables which inform both the players and the dealers of the current size of the jackpot or jackpots that can be won when playing the jackpot component of the game.

The system further involves the house dealer in the necessary decision making and control of the game by providing appropriate means, such as push buttons operatively connected with the central computer, displays, etc., for signalling when a player on any given table has won a jackpot. The computer then automatically deducts the winning from the jackpot total shown on the displays. To facilitate the control of the game, the system further includes for each table an appropriate, typically electronic lockout mechanism. When activated by the dealer at the commencement of a card game, the lockout mechanism prevents the coin acceptors on that table from generating a signal, to thereby prevent unauthorized late betting. Once the game is over, the dealer reactivates the acceptors for the next game.

Another aspect of the present invention provides a gaming table particularly well suited for playing live card games within the above-discussed system for generating large jackpots which can be won by any participating player on any of the tables of the system. Such a table includes a table top with a cut-out proximate each player position on the table and coin acceptors formed of generally circular disks that are placed on the table top and over the corresponding cut-outs therein.

Displays showing the cumulative, available jackpots are preferably mounted on or positioned in close proximity to the table. The table includes the required controls for the dealer to prevent further betting on the table when a card game is about to commence and to signal to the central computer when a jackpot on that table has been won so that a corresponding amount can be deducted from what is shown on the displays. Further, of course, the table includes appropriate connections for the required communications between the coin acceptors, the dealer controls, the displays (if mounted on the table), and the central computer.

Another aspect of the present invention relates to the construction and functioning of the coin acceptor which is located at each player position on all tables. To not interfere with the functional arrangement and aesthetic appearance of conventional live card playing tables, and in particular blackjack tables, while keeping costs low, each coin acceptor is preferably a circular disk the under side of which is placed directly on top of the conventional felt on the table so that the disk covers the table cut-out beneath it. The disk has a preferably concentric, circular recess in its upper side that is shaped to accept the coin and a sight aperture which extends through the disk and is located in the recess so that a coin placed in it covers the aperture. The outer periphery of the disk is frustoconically shaped and extends from about the under side to the upper side at an appropriately shallow angle of, for example, no more than 30° so that players can readily slide a coin along the felt, up the frustoconical ramp of the disk, and into the recess to place a bet for participating in the jackpot component of the game.

Beneath the disk, inside the table cut-out, is a printed circuit (PC) board which is preferably demountably secured to the disk with a screw or the like and which mounts a sensor for sensing the presence of a coin in the recess of the disk, a light source for visibly indicating to both the player and the dealer that a jackpot side bet has been placed, and the necessary electric circuitry for generating a signal indicating the presence of a coin in the recess and energizing the light source. To facilitate both the initial assembly and installation of the acceptor and its subsequent maintenance, the PC board further includes a quick disconnect coupler for supplying the required electric power for the circuitry and for forwarding coin-present signals from the sensor to the central computer. The PC board further automatically positions the sensor at the sight aperture and the light source at a location so that it is visible to the player and the dealer.

The coin acceptor of the present invention can be installed directly on top of existing, otherwise conventional card tables and requires no more than forming the associated cut-outs in the table top and securing the disk to the table, either by screwing it directly into the table top or, preferably, providing a clamp plate which is drawn against the under side of the table top with screws that extend through both the disk and the table top. In this manner existing, already installed live card tables can be readily and relatively inexpensively converted for participating in the large jackpot winnings attainable with the system of the present invention because the need for special tabletop configurations, molds and the like is eliminated.

Thus, the present invention for the first time makes it feasible to provide large jackpots, comparable in size to jackpots that can be won on currently existing systems which combine large numbers of slot machines, such as the system widely known and played under the service mark MEGABUCKS®. This is expected to greatly enhance player satisfaction when playing live card games and significantly increase player participation in such games.

DETAILED DESCRIPTION OF THE PREFERRED EMBODIMENTS

Figure 1:
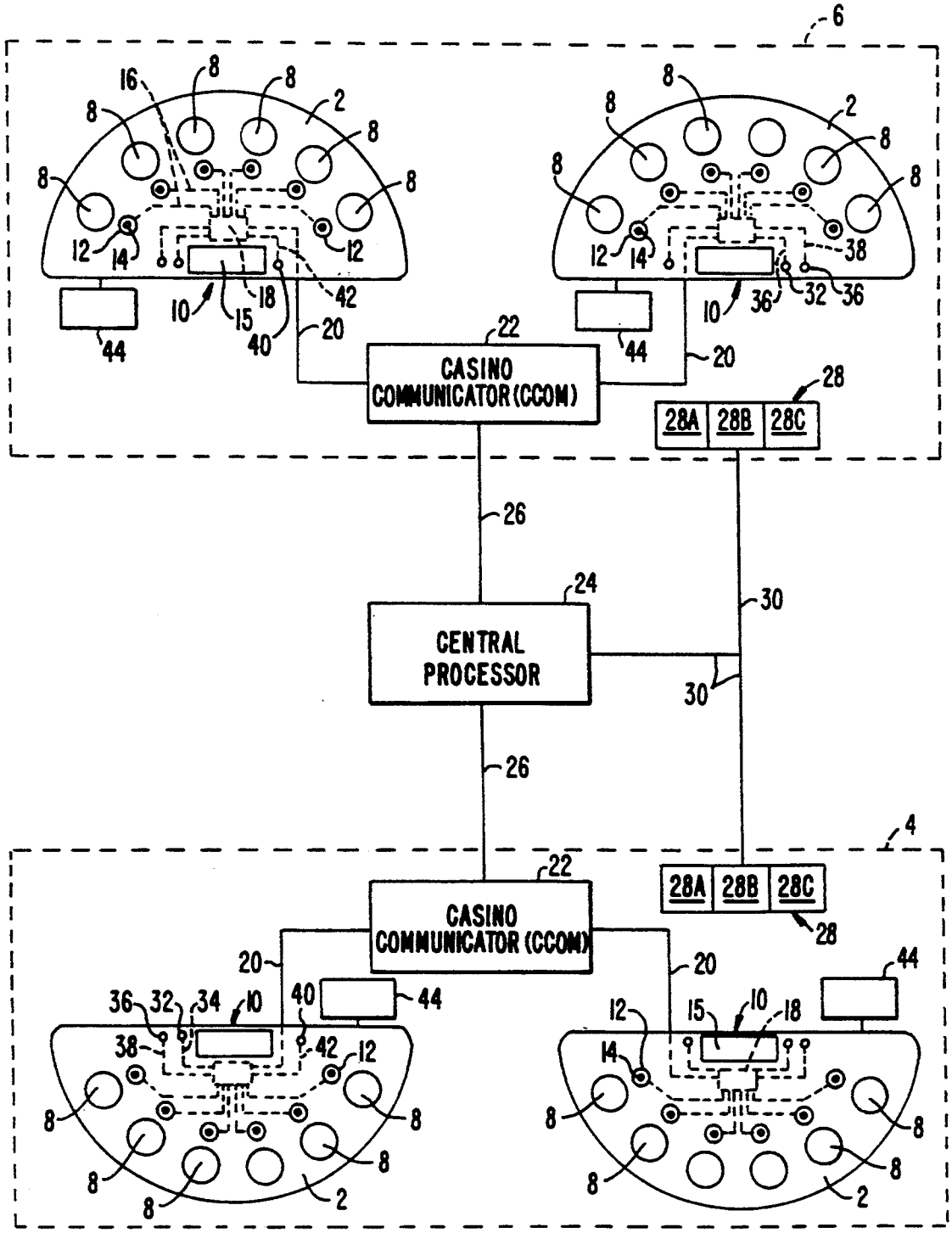
FIG. 1 is a schematic layout and shows multiple live blackjack card playing tables located in different gaming establishments and electrically connected to a central computer for playing blackjack with a jackpot component capable of generating very large jackpots.
Figure 2:
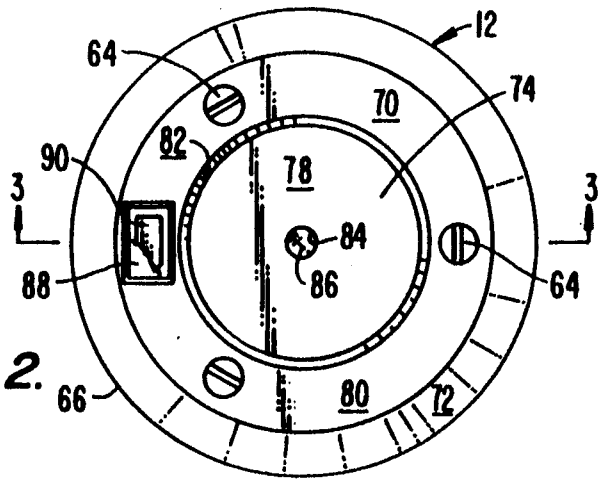
FIG. 2 is a plan view of a coin acceptor constructed in accordance with the present invention.
Figure 6:
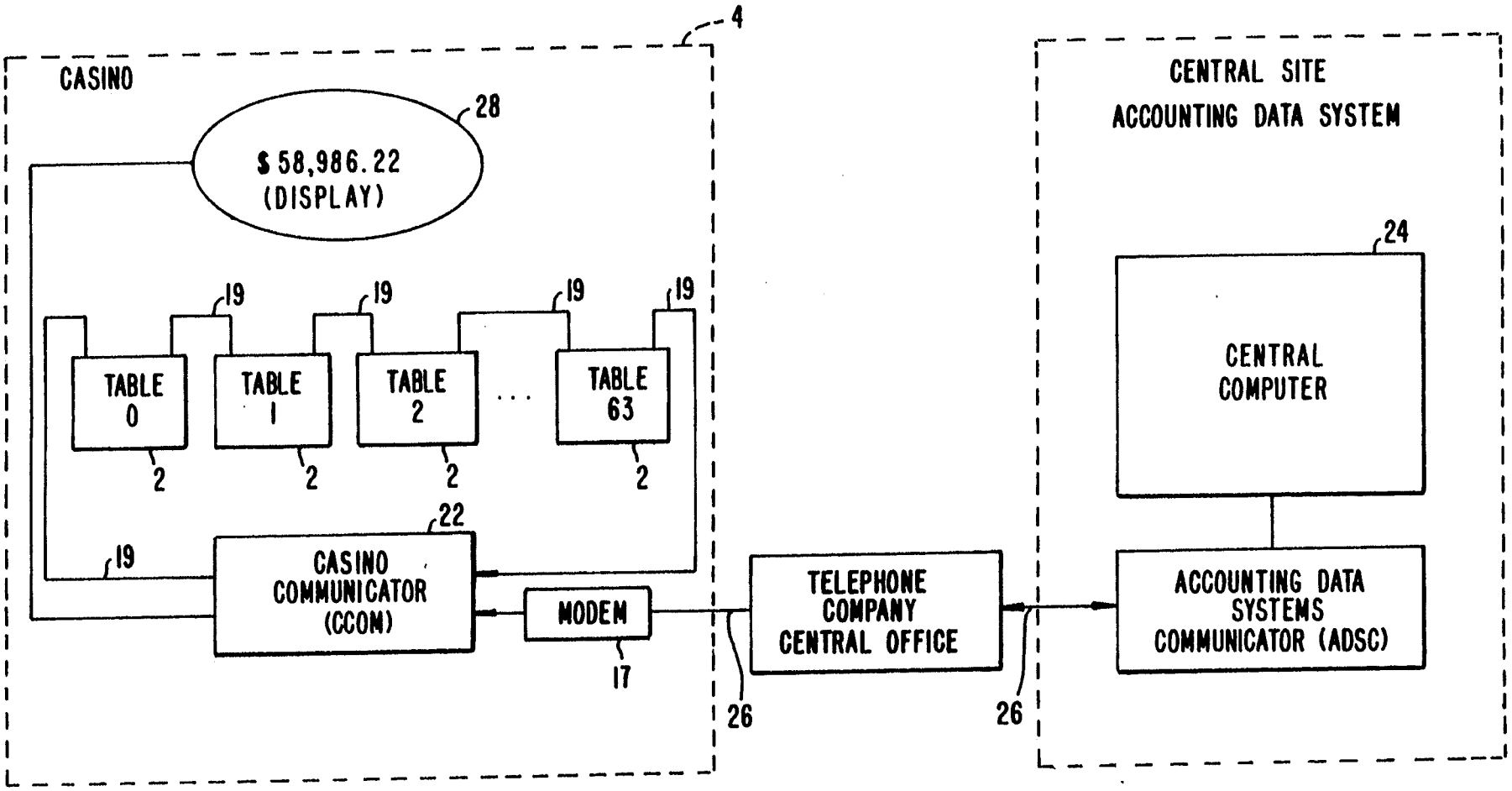
FIG. 6 is a diagram which schematically illustrates the overall system fiber optics connections between the central computer and the individual conponents.
Figure 7:
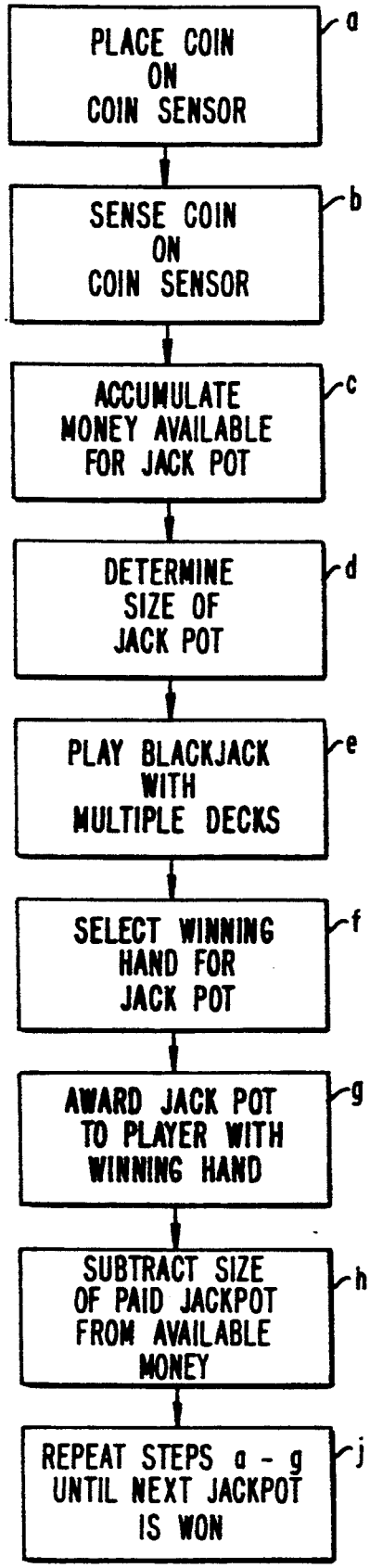
FIG. 7 is a flow diagram showing the operation of the present invention.

Referring first to FIGS. 1 and 6, a plurality of live blackjack card playing tables 2 are shown placed in gaming establishments or casinos 4, 6 located at different geographic locations within a city, state or country, for example. Each table has a generally half-round shape, as is conventional for blackjack tables, and a plurality; e.g. six or seven, of player positions 8 and a dealer position 12 which includes a conventional coin tray 15 in front of the dealer. During play, each participating player occupies one player position from where he places his bets, and the dealer, from the dealer position, deals the cards, collects the bets, and pays out the usual blackjack winnings as is conventional.

In addition, a coin acceptor 12 associated with; i.e. assigned to, each player position is preferably located approximately on or in the vicinity of a line connecting the player position with the dealer position. The detailed construction of the coin acceptors is given later, and each includes a sensor 14 for detecting when a coin (not shown in FIG. 1) is placed on the acceptor by a player. The sensor, and associated electric circuitry described below, generates a signal indicative of the presence of a coin on the acceptor which, in one embodiment of the invention, may be transmitted over a line 16 to a table control box 18 provided for each table. Further lines 20 lead from the table control boxes of all tables in the casino to a casino communicator 22 (CCOM) which includes a micro-processor for the collection of relevant data from the individual tables, such as coin-in, coin-out, etc. information, and which communicates with a central computer or processor 24 via modems and telephone lines 26.

Preferably, however, all tables 2 of a casino may be fiber optically connected in series with fiber optic lines 19 for communicating with the casino communicator 22, as is illustrated in FIG. 6. However, the same data is communicated between the CCOM and the tables as in the embodiment shown in FIG. 1.

In instances in which the overall system is formed by tables within a single casino only, the CCOM 22 can be used to perform the functions of the central computer, although, when desired, especially in instances when the number of tables in such a casino is large, a central computer can, of course, be used, which will typically be located in that casino as well. When the system includes tables in multiple, separate casinos, as schematically illustrated in FIG. 1, the central computer will normally be off-site; for example, on the premises of a separate jackpot servicing organization which operates the system on behalf of the casinos.

Each table, or at least each participating casino, is provided with a display 28 which shows the current size of the jackpot that can be won by players on tables 2 as will be further described below. In instances in which players during any given game can win one of a plurality; e.g. three, of different jackpots, a separate display 28 may be provided to indicate the size of each jackpot, or the display is divided into three sections 26A–C for showing the size of each jackpot. Lines 30 connect each display with the central computer.

In the vicinity of the dealer position 10, each table also includes a "Start Game" or lockout button 32 which is connected with sensors 14 of the coin acceptors 12 of that table only via lines 34 and table control box 18. When the lockout button is activated; e.g. depressed by the dealer, the coin acceptors on that table will be deactivated so that, thereafter, the placement of a coin on the acceptor will not be sensed and recorded by the central computer, as further described below, to thereby prevent late betting. The same lockout button 32, or a separate End Game button 36 connected with the acceptors on that table only via lines 38 and table control box 18, is used by the dealer after the completion of a game on that table in preparation for the next game. The activation of the End Game button enables the players to again place bets on the coin acceptors for participating in the jackpot component of the next game.

There is further a win button 40 in the vicinity of the dealer position of each table which is connected with central computer 24 via a win line 42, table control box 18, line 20, casino communicator 22 and line 26. When, as further described below, a player on a table has a hand of cards which wins a jackpot, the dealer activates the win button and thereby signals to the central computer to deduct the amount of the jackpot from its memory and to correspondingly change the thereafter available jackpot winning(s) on the displays 28 to keep all players and dealers apprised of the available jackpots.

In a currently preferred embodiment, control buttons 32, 36 and 40 are incorporated on a control panel 44 (shown in FIG. 5 and further described below) which may be mounted, for example, at the dealer position of each table and below the table surface out of sight of the players.

Turning to the manner in which the preferred game of blackjack is played, as far as the participating players can tell, each table 2 appears like a conventional live blackjack table except for the provision of a coin acceptor 12 at each player position. Before the start of a game, each player has the option of playing conventional blackjack by placing his bet on the table in front of his position. He can also participate in the jackpot component of the game by making an additional side or jackpot bet, to signal his desire at a chance to win one of the available jackpots. When such a side bet is made, sensor 14 detects the presence of a coin on the acceptor and generates a signal which is relayed to the central computer. The computer increments the cumulative jackpot total by a corresponding amount, either by the face value of the bet coin or, more typically, by a predetermined percentage thereof. The jackpot total(s) shown on displays 28 is(are) correspondingly increased.

At the commencement of the game, the dealer depresses the Start Game button so that, thereafter, no further jackpot side bets can be placed or, if placed, will not generate a signal that is received by the computer, so that such a bet will not count. To enable the dealer to differentiate between valid and invalid side bets; that is, between timely side bets and side bets made late, each acceptor includes a signalling device, preferably a light (not shown in FIG. 1), which is energized when the side bet is timely but which remains deenergized if the side bet is late.

After the cards have been dealt and opened, the dealer pays conventional (single table) blackjack winnings and collects the bets of players with losing hands.

To enable the payout of large jackpots, blackjack is played on each table included in the overall system with a plurality of preferably six full decks of cards. The card combination with which a jackpot can be won is predetermined and selected to lower the probability of receiving such a hand during any game sufficiently so that, according to the laws of probability, very large jackpots can accumulate. As an example, to generate jackpots which can rise to as much as $1 million or more, one can designate a winning hand as being composed of four "5s" plus an ace, all of the same suit, such as hearts or spades, for example. Jackpots of lesser sizes can be obtained, for example, by requiring the player to have three "7s" of the same suit. Other combinations to adjust the statistical size of the attainable jackpot can, of course, be selected in accordance with the laws of probability.

When a player who participates in the jackpot component of the game has a jackpot winning hand, the dealer depresses win button 40. The central computer 24 will then subtract from the accumulated, available jackpot total the jackpot just won by the player. The central computer also correspondingly adjusts the totals shown on all displays hooked up to it. The player or, in the case of large jackpots, the casino, after going through required win verification procedures, pays the jackpot to the winning player, directly on the table or at a separate site (especially for large winnings) as may be appropriate and desirable under the circumstances.

Figure 5:
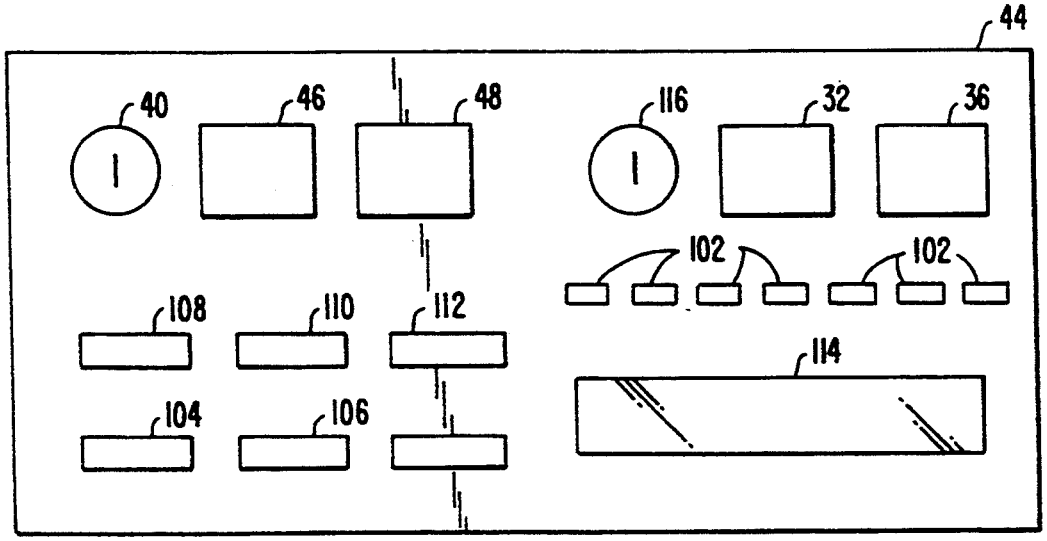
FIG. 5 is a plan view of a presently preferred control panel placed at the dealer position of each table shown in FIG. 1 and enabling the dealer to control the game, including the timing of betting and signalling when a jackpot was won by a player at that table.

If the system provides for the payment of more than one jackpot; for example, when, in addition to a very large jackpot in excess of $100,000 or $1 million, a player can also win lesser jackpots of, say, $50 or $100, additional, secondary jackpot win buttons 46, 48 are located proximate the dealer position of each table and, preferably, they are incorporated in control panel 44 (shown in FIG. 5).

Once all winnings have been paid off, or arrangements for off-site payments have been made, the dealer touches the End Game button 36 to again permit betting and another game cycle as described above begins.

Referring now to FIGS. 1–5, each live table 2 has a flat, horizontal, usually wooden table top 50, suitably supported on the floor, which has conventional padding 52 and a typically green layer of felt 54. The table top includes a cut-out 56 for each player position which is located between the player position and the dealer position and extends through the top as well as the padding and the felt. Coin acceptor 12 is placed on top of the felt and fully covers the cut-out. A clamping plate 58 includes a cut-out 60 which provides full access to table cut-out 56 and is pulled against an under side 62 of the table top by screws 64 which are threaded into the clamping plate and which have heads engaging the acceptor so that, by tightening the screws, the plate and the coin acceptor are firmly clamped to the table top, including the felt, to thereby securely and demountably attach the coin acceptor to the table and maintain the felt taut. The clamping plate includes a grounding screw 57 which is pressfit into a hole in the plate.

Figure 3:
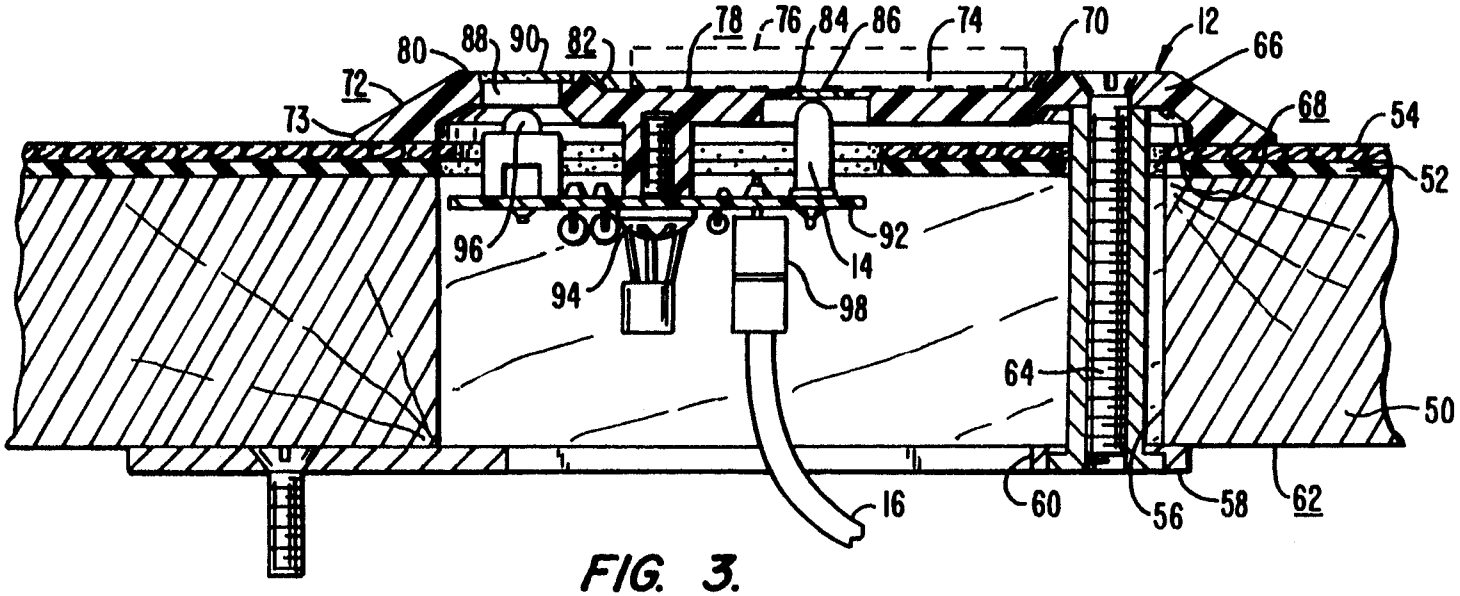
FIG. 3 is a side elevation, in section, and is taken on line 3—3 of FIG. 2.

Coin acceptor 12 preferably is made of a circular disk 66 having an under side 68 placed directly against felt 54 and an upper side 70. The disk is kept as thin as possible. In a presently preferred embodiment it has a thickness of about 0.26 inches (6.6 mm) so that it protrudes minimally above the table felt. Its circular periphery forms a frustoconically shaped peripheral surface 72 which slopes upwardly from about the felt to the upper surface of the disk at a moderate angle, preferably no more than 30°, so that a player can slide, as is typical in gaming, a coin along the felt and over the frustoconical periphery of the disk onto its upper surface without having to pick it up. The lower edge 73 of the frustoconical surface is preferably formed as shown in FIG. 3 to prevent the formation of a sharp edge which could be damaged during use and render the acceptor unsightly.

The upper side of-the disk has a circular, depressed recess 74 of a diameter slightly larger than the diameter of coin 76 so that as the player slides the coin onto the upper surface of the disk it will gravitationally drop into the recess. To facilitate the subsequent removal of the coin from the recess, a bottom surface 78 thereof is connected to the remainder of the upper side, an annular, horizontal face 80, by a sloping surface 82 so that the coin need not be picked up but, instead, can be conveniently slid out of the recess.

Disk 66 further includes a sight aperture 84, preferably concentric with the disk and the circular recess 74, and closed by a transparent lens or glass 86 to prevent contamination of the sight aperture. The lens is flush with recess bottom 78 to facilitate its cleaning. There is also a rectangular opening 88 in the disk, preferably located so that it is visible to both the player and the dealer; e.g. in annular face 80 of the disk, and closed with a translucent; e.g. white or colored, window 90 to prevent contamination from entering the opening and to increase visibility of the window when backlit as described below.

Detachably secured to the under side 68 of disk 66 with a screw 94 is a PC board 92 which is disposed within table cut-out 56. The PC board mounts and positions coin sensor 14 in substantial alignment with sight aperture 84 and a light source 96, such as a LED, in substantial alignment with window opening 88 when the board is attached to the disk. The light source 96 functions as a visual "Coin Accepted Indicator". A quick-connect electric coupler 98 protrudes from the under side of the board into or through the table cut-out 56 for connection to line 16 leading from the PC board of the coin acceptor to the table control box 18.

Figure 4:
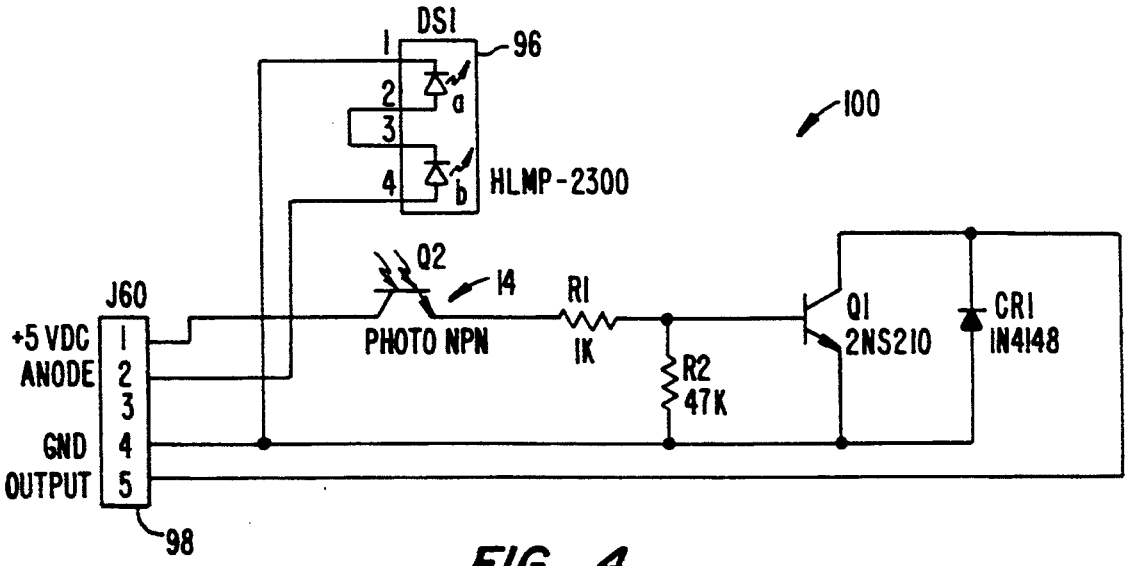
FIG. 4 is an electric circuit diagram of the circuitry incorporated in the coin acceptor shown in FIG. 2.

Referring to FIGS. 3 and 4, the PC board includes electric circuitry 100 for energizing LED 96 when sensor 14 detects the presence of a coin in recess 74 of disk 66. In a presently preferred embodiment of the invention, the sensor is a Darlington photo transistor (Q2) connected with terminal 1 of connector 98 to which +5 VDC is applied. The photo transistor is connected with ground terminal 4 of the connector via a 1K resistor R1, 47K resistor R2, and a transistor (2N5210), and, finally, a protection diode CR1 (1N4148) is provided for electrostatic discharge purposes.

Pin 5 of connector 98 is the output line and a Hewlett Packard HLMP-2300 LED connected with cathode pin 2 and ground pin 4 serves as light source 96.

In use, with PC board 92 installed beneath acceptor disk 66, ambient light entering sight aperture 84 through glass plate 86 turns on the photo resistor Q2 forming sensor 14. When a coin is placed in recess 74, ambient light is cut off, the photo sensor is turned off, and so long as the dealer has not depressed the Start Game (lockout) button 32, the LED of light source 96 will be energized and a signal will be sent to the central computer 24 to increment the accumulated total of the jackpot(s) as a result of this bet. The light source illuminates window 90 of the coin acceptor to visually signal to the player and the dealer that a jackpot side bet has been placed and is in play.

Although the construction of the sensor was described as being simply capable of sensing the presence or absence of a coin in the recess of the coin acceptor, if desired, appropriate sensors can be used which are capable of discriminating between different types of coins. This is especially useful when playing with tokens which can be appropriately marked on their faces so that a sensor can discriminate between different token denominations. In this manner, enhanced bets can be placed should this be desirable.

Referring to FIGS. 1 and 5, as already mentioned, in a preferred embodiment of the invention a control panel 44 is mounted to each table 2 adjacent the dealer position; e.g. to the left thereof. The control panel is preferably positioned beneath the table top and is slightly sloped downwardly and away from the table so as to be easily viewed by the dealer while being out of the players' view. The panel preferably includes a series of seven LEDs 102 that are lit with the lights 96 of the coin acceptors 12 on that table so that the dealer can determine at a quick glance who has placed a jackpot side bet. The panel may further include meters 104 and 106, for example, to provide the dealer with information concerning the cumulative number of coins paid in at the table in question and/or systemwide and the number of games played over a given period. Meters 108, 110 and 112 on the control panel show the current sizes of the primary, secondary and tertiary jackpots, for example, by displaying the coin value of the jackpots divided by 10. Preferably there is also an LCD display 114 for dealer messages, system diagnostics, etc. and a reset key 116. Additional meters, indicators, controls and the like may, of course, be on the panel as needed or desired.

During play, each player can participate in either conventional jackpot, the jackpot component of 21 as described above, or both. To participate in the jackpot component, he places the appropriate coin into the coin acceptor recess 74 at his playing position, which turns off sensor 14, activates the corresponding LED 102 on the dealer panel 44, and sends a signal to the central computer that a jackpot side bet has been placed so that the computer can increase the jackpot total(s). After all bets have been placed, the dealer hits the Start Game button 32, after which further jackpot side bets will not be accepted, and deals the cards. Regular 21 game winnings are paid, and when a player has a jackpot hand, the dealer verifies the cards and thereafter hits the appropriate one of the jackpot buttons 40, 46 and 48. This causes the central computer to assign the jackpot to the winning player's table, subtracts the jackpot from the total available jackpot winnings accumulated by the computer, and appropriately resets displays 28 to thereby preclude the possibility that a jackpot of the same hand is won by a player on another table before the jackpot that is to be paid out has been deducted from the available total.

Smaller jackpots; say, up to a preset amount such as $100 or $500, can be paid directly by the dealer. When larger jackpots are involved, and as an added security measure, reset switch 116 may, for example, be a key-operated switch which is controlled by the pit boss and must be turned before play can resume, usually after the winning has been verified by the pit boss and arrangements for its payment have been made.

What is claimed is:

1. A coin acceptor for use on live gaming tables having a flat, horizontal table top including a cut-out through the top at a location where the acceptor is to be installed, the acceptor comprising a disk having an under side for placement on the table top and an upper side; a sight aperture extending through the disk; a sensor mounted to the under side of the disk and positioned in substantial alignment with the sight aperture for detecting the presence of a coin on the upper side of the disk; circuit means operatively coupled with the sensor for generating a signal responsive to the presence of a coin on the upper side and for transmitting the signal; and means for securing the disk to the table top.

2. A coin acceptor according to claim 1 including a recess formed on the upper side, disposed about the sight aperture and sized to receive a coin so that the coin covers the sight aperture.

3. A coin acceptor according to claim 1 wherein the disk includes a periphery defined by a sloping surface extending substantially from the under side to the upper side of the disk to facilitate a slidable movement of a coin from the table top onto the upper side when the acceptor is installed on the table top.

4. A coin acceptor according to claim 3 wherein the periphery is curved.

5. A coin acceptor according to claim 4 wherein the periphery is substantially circular.

6. A coin acceptor according to claim 1 wherein the circuit includes a light source and means for energizing the light source when the sensor detects the presence of a coin on the upper side of the disk.

7. A coin acceptor according to claim 6 including a board for mounting the circuit means including the sensor and the light source; and means for securing the board to the under side of the disk so that the board positions the sensor in substantial alignment with the sight aperture.

8. A coin acceptor according to claim 1 wherein the means for securing comprises a plate including a cut-out adapted to be in substantial alignment with the cut-out in the table top, and means for biasing the disk and the plate against opposing surfaces of the table top to thereby secure the acceptor to the table.

9. A coin acceptor for use on live card gaming tables having a flat, horizontal table top and a cut-out in the top where the acceptor is to be installed, the acceptor comprising a substantially circular disk having an under side for placement against the table top and an upper side, the disk including a recess in its upper side shaped to accept therein a coin, a sight aperture extending through the disk and located in the recess so that the coin when placed in the recess covers the aperture, a frustoconical peripheral surface between the under side and the upper side for facilitating slidable movement of a coin from the table top along the frustoconical surface and into the recess, and an indicator opening extending from the upper side to the under side and located between the recess and the frustoconical peripheral surface; a board secured to the under side of the disk and mounting a sensor for detecting the presence of a coin in the recess, a light source, circuit means for generating a signal and for energizing the light source when a coin is present in the recess, and means for coupling the circuit means including the light source and the sensor with a source of electric power and for transmitting the generated signal, the board being shaped so that the sensor is in substantial alignment with the sight aperture and the light source is in substantial alignment with the opening; and means for securing the disk to the table top.

10. A coin acceptor according to claim 9 wherein the recess is circular in shape and defined by a bottom, and including a sloping surface between the recess bottom and the upper side of the disk for facilitating a slidable removal of the disk from the recess.

11. A coin acceptor according to claim 9 including a cover closing the sight aperture to prevent contamination of the aperture and the sensor, the cover being flush with the recess bottom and constructed of a material permitting the sensor to detect through the cover the presence of a coin in the recess.

12. A coin acceptor according to claim 9 including a light transmitting window placed over the opening to prevent a contamination of the opening and the light source.

13. A gaming table for playing a card game by a plurality of players and a dealer, the table comprising a table top including a top felt layer and cut-outs in the top at locations proximate playing positions for the players on the table and generally intermediate the player positions and a position on the table for the dealer; a coin acceptor for each player position on the table, the coin acceptor including a generally circular disk, an under side placed against the felt layer and covering the cut-out, an upper side, a recess in the upper side including a recess bottom, a frustoconical periphery extending from about the under side to about the upper side, a sloping surface extending from the recess bottom to the upper side, the frustoconical surface and the sloping surface being configured to enable sliding movement of a coin between the felt and the recess without a need to lift the coin off the felt or the disk, the disk further including a sight aperture and a light window both extending through the disk and being located within the recess and outside the recess, respectively; a board disposed in the cut-out and secured to the under side of the disk; detection means mounted on the board comprising circuit means including a light source and a sensor for sensing the presence of a coin in the recess and for generating a signal and for energizing the light source when the sensor detects the presence of a coin in the recess, and a connector for connecting the circuit means to an electric power source and for transmitting the signal, the board being configured so that when it is attached to the disk the sensor is in substantial alignment with the sight aperture and the light source illuminates the opening; means protecting the sight aperture and the opening against contamination entering from the upper side of the disk; and means for securing the disk to the table top.

14. A gaming table according to claim 13 wherein the window is positioned in a portion of the upper side closest to the dealer position.

15. A gaming table according to claim 13 wherein the securing means comprises a plate positioned against a downwardly facing side of the table top and including a cutout in substantial alignment with the cut-out in the table top, and means connecting the disk to the plate and biasing both against the table top to thereby secure the acceptor to the table top.

16. A gaming table according to claim 15 wherein the biasing means comprises screw means threadably connecting the disk and the plate.

17. A gaming table according to claim 13 wherein the upper side of the disk defines an annular, flat surface between the recess and the frustoconical surface which is substantially parallel to the under side of the disk, and wherein the opening is located radially outward of the recess.

18. A gaming table according to claim 17 wherein the opening extends through the flat annular surface.

19. A gaming table according to claim 13 including means accessible through the cut-out in the table top for detachably securing the board to the disk.

20. An enhanced jackpot payoff gaming system for live card games at a plurality of gaming locations comprising:

a gaming table at each location, each table having a plurality of positions for card players and a position for a card dealer and a table top including a top layer of felt;

a coin acceptor at each player position on the tables for permitting each player to place a side bet for a card game being played on the player's table, the coin acceptor being mounted on the table top and including a disk, a recess formed on an upper side of the disk adapted to receive a coin for the side bet, a sensor for detecting the presence of a coin in the recess, and circuit means for generating a signal when the sensor detects the presence of a coin in the recess;

a computer operatively coupled with the circuit means of each coin acceptor at each player position on the tables for accumulating a jackpot of available payoff money in response to receipt of said signals from the coin acceptors;

means operatively coupled with the computer for communicating to the players on the tables of the system the current size of the jackpot;

means at each table located proximate the dealer position for preventing the generation of signals by the acceptors on that table when a coin is placed thereon after commencement of a card game on that table and while said card game is in progress; and payoff means for each table of the system, located proximate the dealer positions and operatively coupled with the computer for deducting from the accumulated jackpot of available payoff money an enhanced jackpot payoff won by a player at a player position on the table who placed a coin in the associated coin acceptor.

21. A system according to claim 20 wherein the tables of the system are located in a single gaming establishment.

22. A system according to claim 20 wherein at least some of the tables of the system are located in geographically separate, independent gaming establishments.

23. A system according to claim 20 including a side bet indicator operatively coupled with each coin acceptor for indicating when the sensor detects the presence of a coin on the acceptor.

24. A system according to claim 23 wherein the indicator comprises a light source mounted on the associated coin acceptor.

25. A system according to claim 23 wherein the indicator comprises a light source for each acceptor on each table and means mounting the light sources for the acceptors of the table at a location proximate the dealer position on that table for viewing by the dealer.

26. A system according to claim 20 wherein each acceptor includes a disk mounted to an upwardly facing side of the table top and having a raised upper side, the disk including a frustoconical surface extending from about the upwardly facing side of the table top to the upper side of the acceptor so that a coin to be placed on the acceptor for making a side bet can be slidably moved from the table top over the frustoconical surface and onto the disk.

27. A system according to claim 26 wherein the upper side of the disk includes a recess having a bottom and shaped to receive a coin, and a sloping surface connecting the recess bottom with the upper side of the disk to facilitate slidable movement of the coin out of the recess.

28. A system for playing multiple, independent live blackjack card games at different locations and for accumulating jackpot money and awarding a large jackpot available under the system, the system comprising:

a plurality of live blackjack card playing tables, each table including a table top surface, a plurality of player positions and a dealer position;

a coin acceptor at at least some of the player positions on the tables of the system for enabling players to place a side bet for a chance to win a jackpot, the acceptor being on the table top surface and including means for sensing when a coin has been received by the acceptor, means for generating a corresponding participation signal, and means including a sloping surface contiguous with the table top surface permitting slidable movement of the coin from the table top surface onto the sloping surface and into registration with the means for sensing;

lock-out means at the dealer positions on the tables for preventing generation of a participation signal when a side bet is placed on acceptors of a table once a card game on that table commences and until the card game on that table has concluded;

a computer operatively coupled with the acceptors on all tables for tracking accumulated jackpot money including means for increasing the size of the available jackpot as a function of side bets placed on the acceptors on all tables of the system;

means operatively coupled with the computer for communicating to players and dealers on all tables of the system the size of the currently available jackpot;

payout means at the dealer position of all tables in the system operatively coupled with the computer permitting a dealer to communicate to the computer when a player on that table who placed a side bet on the coin acceptor holds a hand of cards entitled to the jackpot; and wherein the computer is coupled with the means for communicating for subtracting from the accumulated jackpot money the jackpot won by the player with said hand of cards and for communicating to the players and the dealers at the tables of the system a resulting change in the jackpot that can be won by players.

29. A system according to claim 28 wherein the blackjack game playable on the system includes a plurality of jackpots of differing magnitudes winnable by players when they hold predetermined hands of cards; and including a signalling means adjacent each dealer position on the tables of the system operable by the dealer for communicating to the computer which of the plurality of jackpots has been won by a player on that table.

30. A system according to claim 28 wherein the means for communicating includes means for separately communicating to the players and the dealers on the tables of the system the current magnitude of the plurality of jackpots.

31. A system according to claim 28 wherein the plurality of tables is located in a single gaming establishment.

32. A system according to claim 28 wherein the plurality of tables is located at multiple, geographically separated gaming establishments.

33. A method of playing live blackjack card games and providing participating players with an opportunity to win a large jackpot when he holds a hand of predetermined cards, the method comprising the steps of:

(a) playing a multiplicity of conventional, live blackjack games on a plurality of separate, live blackjack card game tables;

(b) sliding a side bet coin along a top surface of a table to a predetermined location on the top surface corresponding to a player position for an opportunity to win said jackpot;

(c) at predetermined locations on top surfaces of the tables sensing the placement of side bet coins;

(d) accumulating money available for payout of the jackpot as a function of each side bet coin placed on the tables;

(e) from the available jackpot money determining the size of the jackpot;

(f) playing blackjack on each table with a plurality of complete decks of cards;

(g) selecting said predetermined hand comprising a hand of cards of like denomination and suit;

(h) awarding the jackpot to a player who holds said predetermined hand of cards and has placed a side bet coin at said location;

(i) thereafter subtracting the jackpot won by the player holding said winning hand of cards from the available jackpot money; and (j) repeating steps (a)–(h) until a next jackpot is won by a player.

34. A method according to claim 33 including the step of locating the plurality of live card tables in a single gaming establishment.

35. A method according to claim 33 including the step of locating the plurality of tables in a plurality of geographically separate gaming establishments.

36. A method according to claim 33 wherein said predetermined hand of cards comprises three cards of the same suit each having a denomination of seven.

37. A method according to claim 33 wherein said winning card includes four cards of the same suit each having a denomination of five.

38. A method according to claim 37 including the step of playing the blackjack games on each of the plurality of tables with six complete decks of cards.

39. A method according to claim 38 wherein said jackpot is at least $1 million.

40. A method according to claim 33 including the steps of establishing a plurality of jackpots of differing magnitude which can be won on the tables of the system, and selecting a like plurality of predetermined, different hands of cards with which the plurality of jackpots can be won.

41. A method according to claim 40 including the step of establishing three different jackpot totals.

42. A method according to claim 33 wherein the step of sensing comprises the step of generating an electrical signal for each side bet coin placed on said locations on the top surfaces of the tables, and including the step of preventing the generation of the signal in response to side bet coins placed on locations on the top surface of a table of the system on which a game of blackjack is about to commence to prevent the placement of late side bets.

43. A method according to claim 33 wherein the predetermined locations at each table are at an elevation different from that of a top surface of the tables, and wherein the step of sliding comprises slidably moving the side bet coin between the elevations while the side bet coin is supported by the table.

44. A method according to claim 43 wherein the step of sliding comprises slidably moving the side bet coin along an inclined surface.

45. A system for playing multiple, independent live card games at different locations and for accumulating jackpot money and awarding a large jackpot available under the system, the system comprising:

a plurality of live card playing tables, each table including a top surface, a plurality of player positions and a dealer position;

a side bet coin detector associated with at least some of the player positions on the tables of the system for enabling players to place a side bet for a chance to win a jackpot, the acceptor including a detection area at a level different from a level of the table top surface and ramp means defining an inclined surface between the table surface and the detection area along which the side bet coin can be slidably moved between the table surface and the detection area while the side bet coin is supported by at least one of the table surface, the inclined surface and the detection area, the inclined surface comprising a first surface which slopes upwardly from the top surface of the table and a second surface which slopes upwardly from the detection area; and computer means operatively coupled with the acceptors on the tables for tracking accumulated jackpot money, including means for increasing and decreasing the size of the available jackpot as a function of side bets placed on the acceptors on the tables of the system and jackpots paid out by the system.

* * * * *